US008819979B2

(12) United States Patent
Kelly

(10) Patent No.: US 8,819,979 B2
(45) Date of Patent: Sep. 2, 2014

(54) SECURITY SYSTEM

(71) Applicant: Sensor Systems, LLC, Denver, CO (US)

(72) Inventor: Jason L. Kelly, Denver, CO (US)

(73) Assignee: Sensor Systems, LLC, Denver, CO (US)

( * ) Notice: Subject to any disclaimer, the term of this patent is extended or adjusted under 35 U.S.C. 154(b) by 0 days.

(21) Appl. No.: 13/898,673

(22) Filed: May 21, 2013

(65) Prior Publication Data

US 2013/0318847 A1 Dec. 5, 2013

Related U.S. Application Data

(60) Provisional application No. 61/652,740, filed on May 29, 2012.

(51) Int. Cl.
*F41A 17/54* (2006.01)

(52) U.S. Cl.
CPC ..... *F41A 17/54* (2013.01)
USPC ..... 42/70.07

(58) Field of Classification Search
CPC ..... F41A 17/54
USPC ..... 42/71.01, 70.06, 70.07, 70.11
See application file for complete search history.

(56) References Cited

U.S. PATENT DOCUMENTS

| | | | | |
|---|---|---|---|---|
| 5,283,971 | A * | 2/1994 | Fuller et al. | 42/70.07 |
| 5,417,000 | A * | 5/1995 | Chen | 42/70.06 |
| 5,487,234 | A * | 1/1996 | Dragon | 42/70.07 |
| 5,953,844 | A * | 9/1999 | Harling et al. | 42/70.06 |
| 6,823,621 | B2 * | 11/2004 | Gotfried | 42/70.06 |
| 7,116,224 | B2 | 10/2006 | Mickler | |
| 7,281,397 | B2 | 10/2007 | Victor | |
| 7,506,468 | B2 | 3/2009 | Farrell et al. | |
| 7,552,467 | B2 | 6/2009 | Lindsay | |
| 8,205,372 | B2 | 6/2012 | Anzeloni | |
| 8,387,294 | B2 | 3/2013 | Bolden | |
| 8,402,799 | B2 | 3/2013 | Victor | |
| 2001/0032405 | A1 * | 10/2001 | Kaminski | 42/70.05 |
| 2005/0046571 | A1 * | 3/2005 | Stigall | 340/572.1 |
| 2010/0315235 | A1 | 12/2010 | Adegoke et al. | |

FOREIGN PATENT DOCUMENTS

WO WO 2005/059467 6/2005

OTHER PUBLICATIONS

"Our Technology—Yardarm Safety First", Yardarm Technologies, LLC, 2013, [retrieved on Jun. 7, 2013], 2 pages. Retrieved from: http://www.yardarmtech.com/our-technology/.

"Yardarm Demonstrates the World's First Wireless Firearm Safety Technology for Connected Gun Owners", Yardarm Technologies, LLC, May 21, 2013, [retrieved on Jun. 7, 2013], 3 pages. Retrieved from: http://www.yardarmtech.com/in-the-news/test-in-the-news-1/.

* cited by examiner

*Primary Examiner* — Reginald Tillman, Jr.
(74) *Attorney, Agent, or Firm* — Sheridan Ross P.C.

(57) ABSTRACT

A remote valuable and/or gun monitoring system and method are disclosed. A module incorporating a motion sensor is interconnected to a valuable or gun. The motion sensor generates a motion signal if movement is detected. The motion signal can be passed to a communication device associated with the valuable or gun owner by a network. Remote locking/unlocking of a trigger lock provided as part of the module interconnected to a gun can also be supported.

16 Claims, 5 Drawing Sheets

SECURITY SYSTEM

CROSS REFERENCE TO RELATED APPLICATION

The present application claims the benefits of and priority under 35 U.S.C. §119(e), to U.S. Provisional Application Ser. No. 61/652,740 filed May 29, 2012, entitled "Security System." The aforementioned document is incorporated herein by reference in its entirety for all that it teaches and for all purposes.

FIELD

A security system incorporating a motion sensor is disclosed. More specifically, the present invention relates to a security system for guns and other objects that can alert the owner when the object being monitored is moved.

BACKGROUND

Gun security is a crucial aspect of gun ownership, particularly in homes with children. In 1991, the U.S. Government General Accounting Office estimated that 8 percent of accidental firearm deaths it reviewed in 1988 and 1989 could have been prevented if the firearms had been equipped with a child-proof safety device. The GAO also concluded that a child-proof safety device could have prevented all firearm accidents reviewed in which children under the age of 6 killed themselves or others. See U.S. General Accounting Office, Accidental Shootings: Many Deaths and Injuries Caused by Firearms Could Be Prevented, March 1991, at 3. In 2009 there were 1,521 accidental firearm-related deaths in the United States and 83 of the deaths were of juveniles. See William J. Krouse, Congressional Research Service, *Gun control Legislation*, Nov. 14, 2012, at 11-12. In 1994, 44 million people in the United States, approximately 35% of households, owned 192 million firearms. By 2007, the number of firearms in the United States had increased to approximately 294 million. See id. at 8.

Typical solutions for providing gun security include trigger locks and gun safes. The fundamental weakness of such lock and key approaches is that the owner of the gun has to assume the security measures have not been circumvented. For example, a child or unauthorized person may have found the key or combination to a gun lock. As a result, the gun is no longer secure, but this fact is unknown to the gun owner or parent. What the gun owner really wants to know is that unauthorized people are not handling the gun. In addition, many guns are intentionally left unlocked so that the owner can have quick access to the gun in the event of an emergency. Where children or unauthorized persons might have access to the gun, the gun owner has an interest in knowing whether the gun has been handled. Therefore, there is an unmet need for a security system for guns that can prevent accidental firearm injuries and notify the owner if the gun has been handled, but ensures the gun is rapidly available for use in an emergency.

SUMMARY

The present invention is generally directed to systems and methods to secure objects that the owner wants to monitor. The present disclosure and figures disclose various embodiments and configurations. These configurations are presented herein for purposes of description and illustration and should not be viewed as limiting the present invention to any particular embodiment or arrangement.

In accordance with embodiments of the present disclosure, a security system with a module that can be secured to an object that the owner wants to monitor is provided. The module includes a motion sensor and a means of sending messages to the owner. If the module is moved, the motion sensor generates a motion signal. This motion signal can be passed by a transmitter/receiver to a communication device associated with the gun owner as a motion detected message generated by a controller. In some embodiments, the security system can be programmed to send a message to the owner if the module is removed from the object. As used herein, the module may simply comprise a security module, and can be used to detect movement of any valuable. In some embodiments, the module may further be designed to be secured to a gun. In some embodiments, a trigger lock is provided to prevent unauthorized users from operating the gun. In other embodiments, the module can send a message to the owner if the trigger lock is unlocked. Accordingly, a gun owner can be notified in real time if a gun has been moved, if the gun module has been removed from the gun, and if the trigger lock is unlocked. In still other embodiments, the module can unlock the trigger when the module detects that a registered user is within a certain distance of the module.

In an embodiment, a security device for an object includes a module capable of being affixed to the object. The module may include a motion sensor which is operable to generate a motion signal in response to movement of the motion sensor, a controller which is operable to generate a motion detected message in response to the motion signal generated by the motion sensor, and a signal transceiver which is interconnected to the controller, and which is operable to send the motion detected message to a communication device.

In another embodiment, a method of securing an object includes interconnecting a motion senor and a transceiver to the object, detecting that the object has been moved, generating an alert message indicating that the object has been moved, and outputting the alert message.

In still another embodiment, a security system includes a module capable of being affixed to an object. The module may include a motion sensor which is operable to generate a motion signal in response to movement of the motion sensor, a controller which is operable to generate a motion detected message in response to the motion signal generated by the motion sensor, and a signal transceiver which is interconnected to the controller and which is operable to send the motion detected message to at least one of a communication device and a system server.

Additional features and advantages of embodiments of the present disclosure will become more readily apparent from the following discussion, particularly when taken together with the accompanying drawings.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

The term "satellite positioning system receiver" refers to a wireless receiver or transceiver to receive and/or send location signals from and/or to a satellite positioning system, such as the Global Positioning System ("GPS") (US), GLONASS (Russia), Galileo positioning system (EU), Compass navigation system (China), and Regional Navigational Satellite System (India).

The terms "determine," "calculate" and "compute," and variations thereof, as used herein, are used interchangeably and include any type of methodology, process, mathematical operation or technique.

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

This Summary is neither intended nor should it be construed as being representative of the full extent and scope of the present invention. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. Moreover, references made herein to "the present invention" or aspects thereof should be understood to mean certain embodiments of the present invention and should not necessarily be construed as limiting all embodiments to a particular description. The present invention is set forth in various levels of detail in the Summary as well as in the attached drawings and the Detailed Description and no limitation as to the scope of the present invention is intended by either the inclusion or non-inclusion of elements, components, etc. in this Summary. Additional aspects of the present invention will become more readily apparent from the Detail Description, particularly when taken together with the drawings.

BRIEF DESCRIPTION OF THE DRAWINGS

The accompanying drawings, which are incorporated herein and constitute a part of the specification, illustrate embodiments of the invention and together with the general description given above and the detailed description of the drawings given below, serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
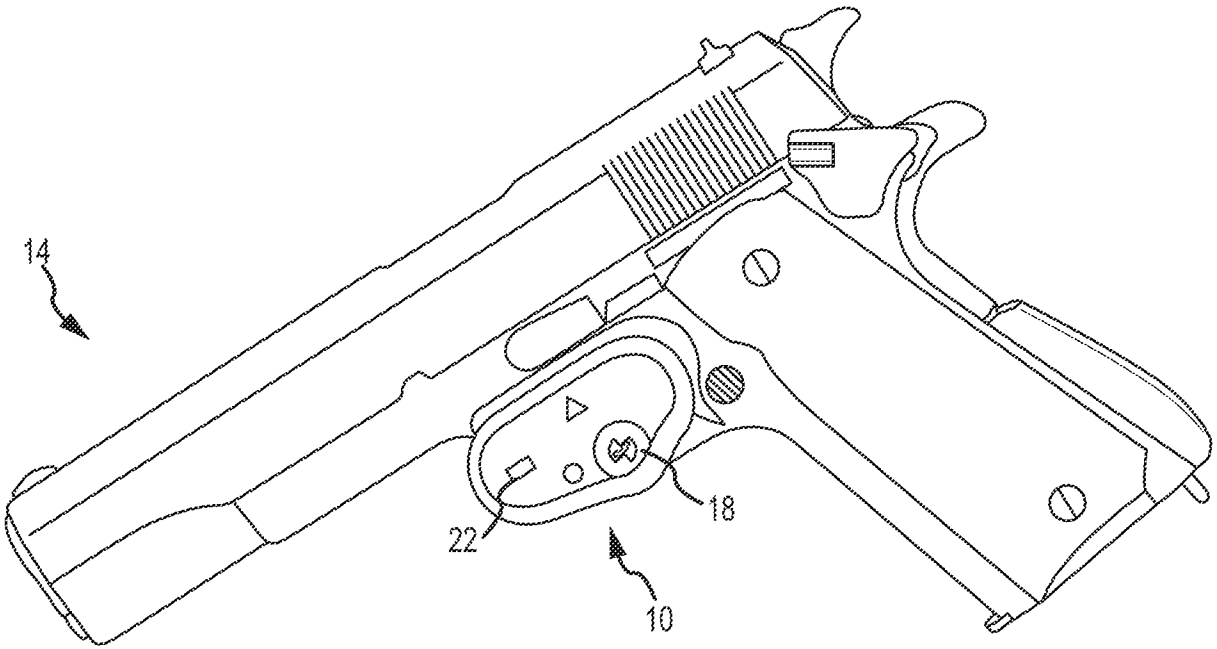
FIG. 1 is a perspective view of a security module affixed to a gun in accordance with embodiments of the present disclosure.

FIG. 1 illustrates a security module 10 or a gun security module 10 affixed or connected to a gun 14. The module 10 is generally adapted for engagement with an object to be monitored. Accordingly, the physical format of the module 10 can be adapted for secure interconnection to the gun 14. In accordance with an exemplary embodiment, the module 10 may be in the form of, or similar to a conventional trigger lock, in which access to the trigger of the gun 14 is physically blocked by the trigger lock, as illustrated in FIG. 1. In other embodiments, the module 10 may be affixed to a gun 14 in different locations to allow access to the trigger. In still other embodiments, the module 10 may have a different shape and a trigger lock that could prevent the trigger of the gun 14 from being pulled without completely covering the trigger assembly.

Although FIG. 1 illustrates the module 10 affixed to a semi-automatic pistol 14, one of skill in the art will recognize that the module 10 may be used with other types of guns 14, such as revolvers, rifles, etc.

The module 10 may include an aperture 18 for a key used to operate a lock that can engage or release the mounting points 26 and/or to lock or unlock a trigger lock. In some embodiments instead of a key, buttons may are provided to operate the lock. In still other embodiments, a radio frequency device or a magnetic key may be used to operate the lock instead of, or in addition to, the key or buttons.

One or more status indicators 22, such as an LED, a light, or a dial, may be provided at various locations on the module 10 to give a user a visual indication of the status of the module 10. For example, status indicators 22 may indicate one or more of the following: system working, battery low, alarm activated, trigger lock locked, trigger lock unlocked, registered user in proximity, etc.

Figure 2:
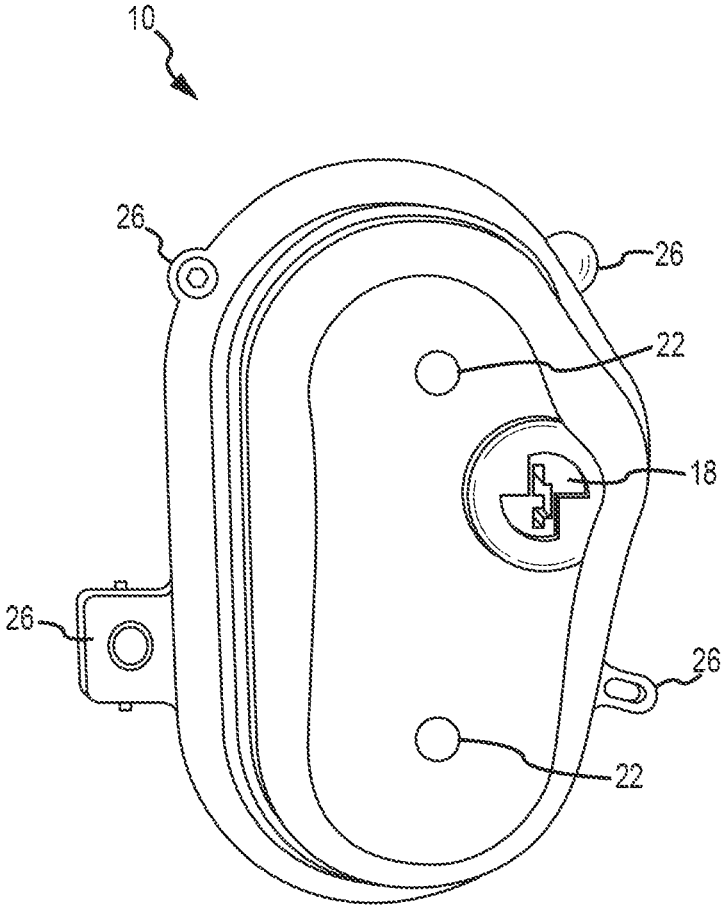
FIG. 2 is a side view of a security module according to an embodiment of the present disclosure.

As illustrated in FIG. 2, the module 10 can include one or more mounting points 26 for mounting the module to an object to be monitored. The mounting points 26 may be located at other positions on the module 10 as necessary to secure the module 10 to an object to be monitored. In some embodiments, the mounting points 26 may be used to affix the module 10 directly to the object to be monitored. In other embodiments, mounting points 26 can include a latch, loop, coupling or other means to affix the module 10 to the object to be monitored.

Figure 3:
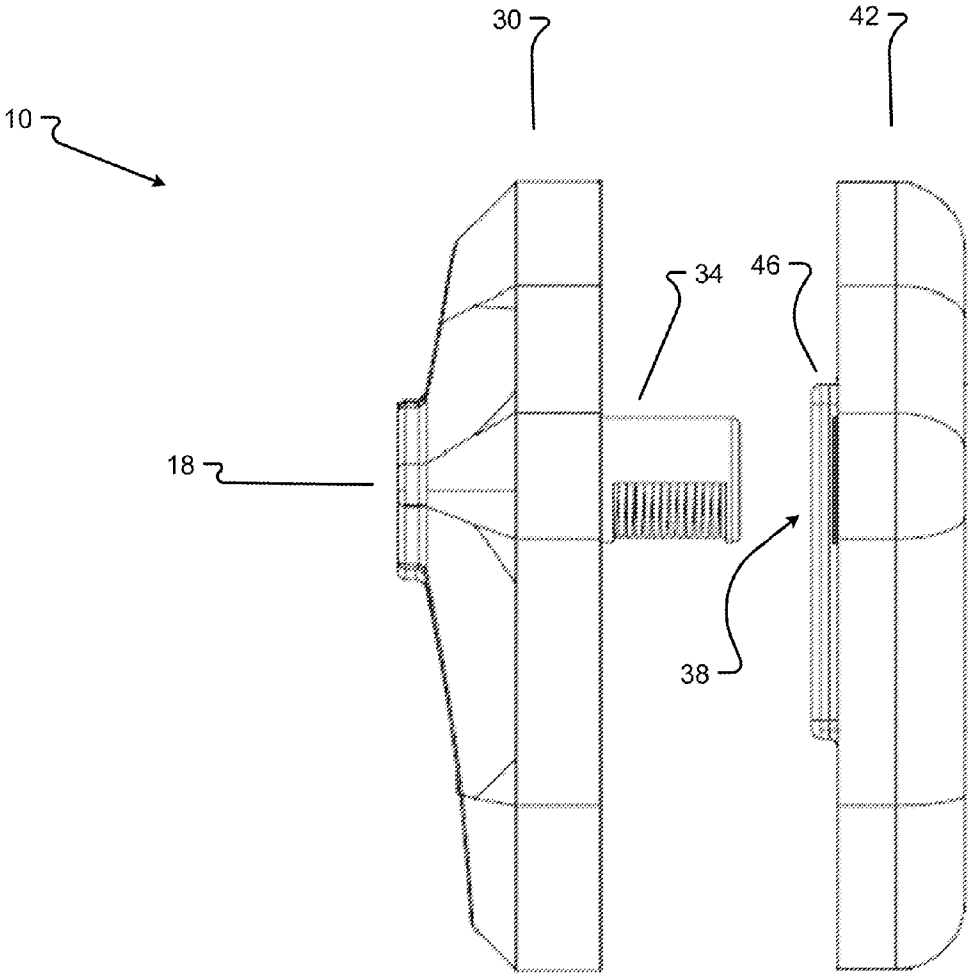
FIG. 3 is a top plan view of a security module according to an embodiment the present disclosure.

In some embodiments, the module 10 may be made of only one piece. In still other embodiments, the module 10 may have two or more pieces that can interlock around or through the object to be monitored, as illustrated in FIG. 3. In the embodiment of FIG. 3, a first piece 30 is shown with the aperture 18 for the lock. The first piece 30 may include an extension 34 designed to interlock with a receiver 38 in the second piece 42. In some embodiments more than one extension 34 and receiver 38 may be provided to interlock the two pieces 30, 42 together. Either or both of the pieces 30, 42 may include an extension or flange 46 and the other piece may have a corresponding receptor (not shown) to help align the two pieces 30, 42, add prevent the two pieces 30, 42 from sliding in relation to each other, and/or to prevent the two pieces 30, 42 from being rotated around the extension 30 and aperture 34.

It is expressly understood that although FIGS. 1-3 depict one configuration and shape of the module 10, the present invention is not limited to these embodiments. It will be recognized by one skilled in the art that the shape of the module 10 can have many forms, with dimensions and design parameters chosen to ensure proper fit and attachment to any object to be monitored. For example, the module 10 may be disc shaped, cylindrical with mounting points that extend outward from the side of the cylinder to allow the system to be secured in a cylindrical opening, etc. In some embodiments, the module 10 could be L-shaped for affixing it to the outside corner of an object.

Figure 4:
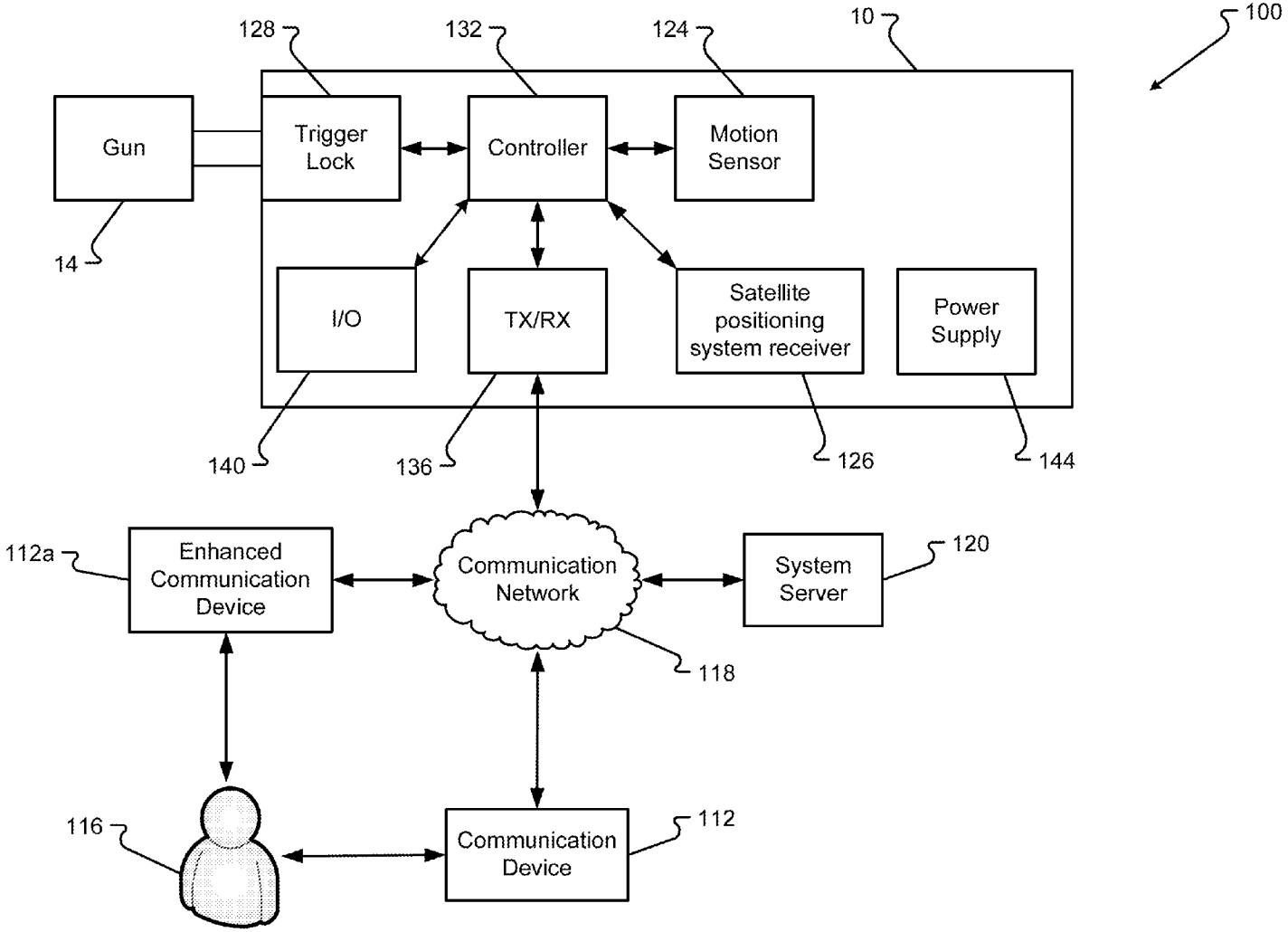
FIG. 4 is a block diagram depicting components of a security system in accordance with embodiments of the present disclosure.

FIG. 4 illustrates components of a security system 100 or gun security system 100 in accordance with embodiments of the present disclosure. In general, the security system 100 includes the module 10. The system 100 additionally can include a communication device 112 associated with a user or owner 116. The communication device 112 can exchange signals with the module 10 through a communication network 118. The communication device 112 can be any telecommunication device such as a cellular device, a smart phone, a tablet device, a laptop, etc. The system 100 can additionally include a system server 120 that can exchange signals with the module 10 and the communication device 112 through the communication network 118.

The module 10 generally includes a motion sensor 124. In an exemplary embodiment, the motion sensor 124 may be an accelerometer; however, any device that is capable of sensing movement of the object to which the module 10 is interconnected, and is capable of generating a motion signal in response to detection of such movement, can be utilized as the motion sensor 124. Moreover, multiple different motion sensors 124 of different types and orientations can be included in the module 10.

In some embodiments, a satellite positioning system receiver 126 may also be included in the module 10. The satellite positioning system receiver 126 is also capable of sensing a change in the location of the object to which the module 10 is interconnected and is capable of generating a motion signal in response to detection of the change of location. The satellite position system receiver 126 may also be capable of generating signals that indicate the current coordinates or location of the module 10. For example, if the module 10 is moved, the satellite position system receiver 126 may send position signals.

The module 10 can additionally include a trigger lock 128. In general, the trigger lock 128 comprises a mechanical assembly that enables the module 10 to be securely interconnected to a gun 14. Accordingly, the trigger lock 128 can include a mechanical lock that includes a lock mechanism and affixing plates to secure the module 10 to the gun 14. The trigger lock 128 can also block operation of and/or access to the trigger of the gun 14. In accordance with at least some embodiments of the present disclosure, the trigger lock 128 can be electronically and/or mechanically locked or unlocked. In these embodiments, the trigger lock 128 is operable to lock in response to a lock command and the trigger lock 128 is operable to unlock in response to an unlock command When the trigger lock is 128 unlocked (either in response to an electronic command or manually unlocked), the trigger lock 128 may generate an unlocked trigger signal. The trigger lock 128 may also generate a trigger pulled signal when the trigger lock 128 is in a locked condition and there is an attempt to pull the trigger.

When the module 10 is removed from an object to which it is attached, the module 10 may generate a module removed signal.

A controller 132 can be incorporated into the module 10 to control various aspects of the operation thereof. The controller 132 may comprise any general purpose programmable processor or controller for executing application programming or instructions. Alternatively, the processor 132 may comprise a specially configured application specific integrated circuit (ASIC). The controller 132 generally operates to run programming code or instructions for controlling operation of the module 10, as described herein.

The controller 132 can receive signals generated by the motion sensor 124, the satellite position system receiver 126, the module 10, and/or the trigger lock 128 to convert the signals to messages, such as a motion detected message, a position message, an unlocked trigger message, a trigger pulled message, a registered user detected message when a registered user is within a proximity of the module 10, a module removed message, etc. The controller 132 may send the messages to a transmit/receive (or transceiver) module 136, for transmission to the communication device 112 and/or the system server 120. The controller 132 can also cause an alarm signal to be output by an input/output facility 140 of the module 10 in response to a motion signal from the motion sensor 124 or the satellite positioning system receiver 126. The controller 132 may also cause an alarm signal to be output by the input/output facility 140 in response to a trigger pulled signal from the trigger lock 128. The alarm may be an audible signal.

In addition, the controller 132 can send lock and/or unlock commands to the trigger lock 128. For example, the controller 132 can send a lock command in response to a motion detected signal from either the motion sensor 124 or the satellite positioning system receiver 126. The controller 132 can send either lock or unlock commands in accordance with a schedule of locking and unlocking times, proximity of the user's communication device 112, and/or in response to signals received from the user 116 or other authority, either through an input/output facility 140 which may be included as part of the module 10, or via the communication device 112 or system server 120. The user or gun owner 116 may also remotely lock or unlock the gun 14 by accessing the system server using any device connected to the internet.

The controller 132 may also generate a status update message randomly or on a schedule set by a user 116. The status update message may be sent by the transceiver 136 to either a communication device 112 or the system server 120. The controller may generate a lock command to lock the trigger lock 128 if no response is received, or if an improper response is received, from either the communication device 112 and/or the system server 120 within a period of time set by the user during registration of the system 100. The controller 132 may also generate a lock command if the controller does not receive a signal from the system server 120 or the communication device 112 at a scheduled time or interval set by the user 116.

The transmit/receive (or transceiver) module 136 can support communications between the module 10 and other system 100 components, such as the communication device 112 and system server 120, via the communication network 118. Examples of a suitable transmit/receive module 136 include an IEEE 802.11 interface (i.e., Wi-Fi interface), a cellular telephony interface, a Global System for Mobile communications (GSM) interface, Bluetooth interface, a wired Ethernet interface, or the like.

The transceiver 136 monitors the communication network 118 and can send a lost network alert to the controller 132 if a connection with the communication network 118 is disrupted or lost. The controller 132 may generate and send a lock command in response to the lost network alert. The transceiver 136 can also provide location monitoring and/or movement information to the controller 132. For example, based on a WiFi access point, cellular base station, or other network 118 node that the transceiver 136 is connected to, the transceiver can provide information related to the location of the module 10. That information can in turn be used to generate an alarm, for example as a method for detecting movement of the module 10, or detecting removal of the module 10 from an authorized area to an unauthorized area.

The input/output facility 140 can comprise an interface that enables the module 10 to be releasably connected to a keypad, keyboard, touch screen interface, or other device or devices for receiving input from the user 116. The input/output facility 140 can additionally include an alphanumeric display, an audible alert, indicator lamps, or other output devices. The input/output facility 140 can further include various input devices, including but not limited to a switch, button, keypad, touch screen or the like, that is is integrated with the module 10. Alternatively or in addition, the user 116 may access the input/output facility 140 through an application on a smart phone or other mobile device.

The module 10 can additionally include a power supply 144. A power supply 144 will typically include a battery and/or capacitive power supply alone, or in combination with, a connection to a utility power supply. The power supply 144 can be recharged by inductive or wireless charging and/or by connection to a MicroUSB or a mini-MicroUSB charging connector.

The communication network 118 can include any network or combination of networks capable of supporting the transmission of messages and information from the module 10 to a monitoring device, such as but not limited to, the communication device 112 and/or the system server 120. Examples of signals that can be transmitted by the communication network 118 include control signals passed between the module 10 and the communication device 112 or system server 120. Accordingly, examples of the communication network 118 include: a Wi-Fi network in combination with the Internet, a cellular telephony network, a Global System for Mobile communications (GSM) interface, a wired Ethernet network, the public switched telephony network (PSTN), or combinations thereof.

The communication device 112 can comprise any device that is capable of receiving input from and providing output to the user 116. Moreover, the communication device 112 has the capability of exchanging communications with the module 10 and/or the system server 120 through one or more communication networks 118. In accordance with at least some embodiments, the communication device 112 can comprise a smart phone, a tablet computer, desk top computer, or other device with at least limited processing capabilities, on which an application is executed. The application can provide an interface to the module 10, and/or the system server 120. Accordingly, through the application interface, the user 116 can control the locking or unlocking of the trigger lock 128, the arming or activation of the motion sensor 124, locking and unlocking schedules, enabling or disabling locking and unlocking based on proximity of the communication device 112 to the module 10, the handling of messages generated by the module 10, or any other aspects of the operation of the system 100. In an exemplary implementation, the communication device 112 is capable of wireless communications. Accordingly, examples of a communication device 112 include, but are not limited to, a cellular telephone, a smart phone, a laptop computer, a tablet computer, a personal digital assistant, or the like.

In accordance with other embodiments, multiple communication devices 112 can be associated with, or registered with, the system 100. For example, the user 116 can assign alternate communication devices 112 to which messages should be provided in response to a generation of signals by the motion sensor 124, satellite positioning system receiver 126, the trigger lock 128, or the module 10. Communication devices 112 can have capabilities to communicate with the controller 132 to remotely lock/unlock the trigger lock 128 in response to commands entered by the user 116 and/or in response to the proximity of the communication device 112 to the module 10.

A user 116 can also put certain communication devices 112 on a list of communication devices 112 to which messages are sent by the controller 132 and the transceiver 136 in response to signals generated by the motion sensor 124, satellite positioning system receiver 126, the trigger lock 128, and/or the module 10. These communication devices 112 may only have authority to receive messages and may not have authority to lock or unlock the trigger lock 128.

Moreover, a user 116 can designate one or more communication devices 112 as enhanced communication devices 112*a*. An enhanced device 112*a* may have authority to remove or unregister other communication devices 112. An enhanced device 112*a* may also receive messages from the module 10 when other communication devices 112 lock or unlock the trigger lock 128 or change the status of the module 10. For example, an enhanced communication device 112*a* may receive a message when the module 10 unlocks the trigger lock 128 when a communication device 112 is within a proximity of the module 10.

The system server 120 may comprise a general purpose programmable computer or server device interconnected to the module 10 and/or the communication device 112 via one or more communication networks 118. The functions of the system server 120 may also be performed by an application running on a smart phone, tablet computer, laptop, or other portable device. The system server 120 can implement various functions, such as directing signals generated by the module 10 and components of the module 10 to the appropriate communication device or devices 112. The system server 120 can also control various other operations of the system 100, such as controlling remote locking and unlocking of the trigger lock 128, either according to a timing schedule, an association with input from the user 116 via the communication device 112 or an input through the output/module 140, or in response to a determined proximity of a communication device 112 with enhanced capabilities and the module 10. The system server 120 can monitor the communication network 118 used to communicate with the module 10. When the system server 120 detects an interruption or interference with the communication network 118, the system server 120 can send a network lost message to a communication device 112 of the user 116. The system server 120 can operate in connection with one or a plurality of modules 10. Moreover, the system server 120 can be implemented as a service accessed through the public Internet, and/or through a private network. In accordance with at least some embodiments, the system server 120 can be operated on behalf of one user 116, or a community of users 116. In accordance with still other embodiments, the system server 120 may be integrated with a communication device, with the functions of the system server 120 being performed by an application running on the communication device 112. In accordance with further embodiments, the system server 120 may comprise a home security system, and/or may be provided as part of a home security monitoring service.

The system server 120 can also transmit a status update request to the module 10 randomly or on a schedule set by a user 116. The transceiver 136 can receive the status update request and the controller 132 can generate a status update response message which the transceiver 136 transmits to the system server 120. The system server 120 may send a no-response message to the communication device 112 if no status update response message is received, or if an improper status update response message is received, to alert the user 116.

Figure 5:
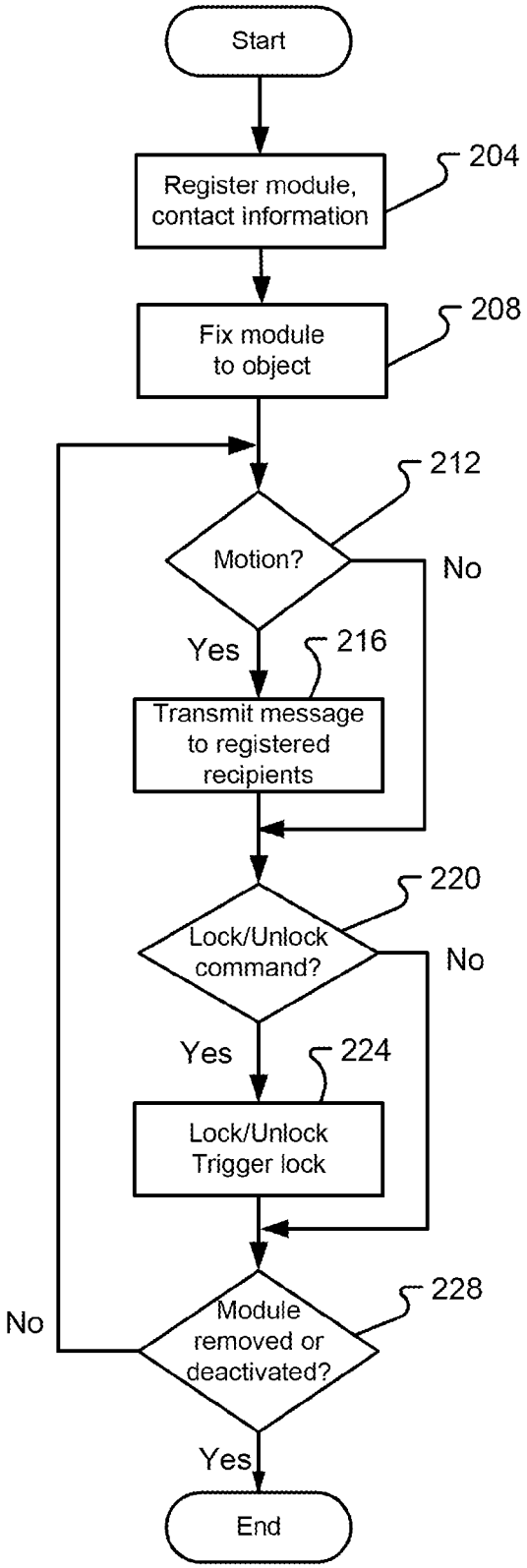
FIG. 5 is a flowchart depicting aspects of the operation of a security system in accordance with embodiments of the present disclosure.

FIG. 5 illustrates aspects of the operation of the system 100 in accordance with embodiments of the present disclosure. Initially, at step 204, the module 10 and user 116 contact information are registered. Registration can include providing address information associated with one or more communication devices 112 to which messages are to be directed. Registration can also include establishing passwords or other security measures for controlling operation of the module 10, such as the operation of the trigger lock 128. Registration can, for example, be performed through the communication device 112, the input/output facility 140 of the module 10, or any other device that can communicate with the module 10 and/or the system server 120.

At step 208, the module 10 is affixed to the object to be monitored, which may be a gun 14. More particularly, where the module 10 incorporates a trigger lock 128, the trigger lock 128 mechanism can be secured to the gun 14 such that access to the trigger can be physically blocked. Securing or affixing the trigger lock 128 to the gun 14 can include mechanically affixing components of the trigger lock 128 to the gun 14, and manually activating the lock mechanism through mechanical means, and/or through an electronic actuator operated by the controller 132 in response to input signals provided by the user 116 through the input/output module 140 and/or the communication device 112. Alternatively, or in addition, the module 10 can be secured to the gun 14 through other means. For example, embodiments of the module 10 can simply include a strap or other fastener for affixing the module 10 to the gun 14, such that a module removed signal is generated if the module 10 is removed or detached from the object being monitored. Alternatively or in addition, a motion detected signal is generated with the module 10 is determined to have moved from an authorized location to an unauthorized location.

At step 212, a determination can be made as to whether movement of the gun module 108 has been detected. In general, if movement of the module 10 is detected by either the motion sensor 124 and or the satellite positioning system receiver 126, either the motion sensor 124 or the receiver 126 may generate a motion detected signal at step 216. The motion detected signal is received at the controller 132. The controller 132 then formats a motion detected message that is transmitted by the transmit/receive module 136 to registered recipients, such as a registered communication device 112 and/or the system server 120. Alternatively, or in addition, the controller 132 can operate an output device provided as part of the input/output module 140, such as an indicator lamp and an audible alarm.

If no movement of the module is detected at step 212, or after transmitting a motion detected message, the process can continue to step 220.

At step 220, a determination can be made as to whether a lock/unlock command has been received at the trigger lock 128. A lock/unlock command can be provided through the input/output module 140 by a user 116. A lock or unlock command can also be provided by a user 116 through a communication device 112. In accordance with still other embodiments, a lock or unlock command can be generated according to a predetermined schedule maintained by the controller 132 and/or the system server 120. As yet another example, an application running on the communication device 112 for interfacing with the module 10 can maintain a schedule for locking or unlocking the trigger lock 128, and for activating or deactivating some or all of the alarm functions performed in response to the motion detected signal from either the motion sensor 124 or the satellite positioning system receiver 126. In still another example, the controller 132 may generate and send a lock command in response to receiving a motion signal generated by the motion sensor 124 and/or the satellite positioning system receiver 126 in step 212. As yet another example, a lock or unlock command can be generated in response to the determined proximity of a registered communication device 112 to the module 10. For example, where a registered communication device 112 is in predetermined proximity to the module 10, such as when a gun owner is in their home, the module 10 can be unlocked, to allow the user 116 to operate the gun 14. The determination of proximity can be made through the application running on the communication device 112, operation of the system server 120, and/or operation of a controller 132. Proximity can be determined through location signals provided by the communication device 112. Alternatively, or in addition, proximity can be assumed when the communication device 112 and the module 10 are connected to the same local area network, or are in direct communication with one another, for example as indicated by a near field communication (NFC), Bluetooth, RFID, or other short range communication link. In response to the detection of a lock/unlock signal, the trigger lock 128 is activated by the controller 132 to lock or unlock the trigger lock 128 (step 224).

If no lock/unlock signal is detected at step 220, or after acting on a lock/unlock signal, the process can continue to step 228.

At step 228, a determination can be made as to whether the module 10 has been deactivated or removed from the object being monitored, such as a gun 14. If the module 10 has not been deactivated or removed from the object being monitored, the process can return to step 212, and the monitoring functions of the module 10 can continue. If the module 10 has been deactivated or removed, the process can end.

In accordance with further embodiments, an alert message can be sent to a larger security system, such as a home security system, for action. For example, the controller 132, either directly or through a system server 120, can provide an alarm system service provider with an alert message. The alarm system service provider can then formulate and send alert messages to the user 116, and/or contact authorities.

In accordance with further embodiments, a module 10 may comprise or be incorporated within a gun case or enclosure, or gun safe. Alternatively, or in addition, a lock component, such as a trigger lock 128, can be omitted. Moreover, embodiments of the present disclosure are not limited to use in connection with a gun. Accordingly, although embodiments of a security system for use in connection with a gun or firearm have been described in examples provided herein, other applications are possible. For example, any article that an owner or other interested party might wish to monitor in order to detect unauthorized handling can be associated with a module and other system components as described herein. For instance, the module 10 may more generally comprise a security module that could be attached to any article or structure that a user desires to secure. Accordingly, a security module, which can have some or all of the components described in connection with a module 10, can be attached to the door of a safe, a jewelry box, a cabinet door, a drawer, an interior door, a sculpture, a painting, or any other article or structure that could be monitored by interconnecting a security module as described herein.

In yet another embodiment, the systems and methods of this disclosure can be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the disclosed embodiments, configurations and aspects includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as a program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. A security device for a gun, comprising:

a module capable of being affixed to the gun and covering a trigger guard of the gun, the module including:

a motion sensor, wherein the motion sensor generates a motion signal in response to movement of the motion sensor;

a controller, wherein the controller generates a motion detected message in response to the motion signal generated by the motion sensor, and wherein the controller generates and sends a lock command in response to the motion signal generated by the motion sensor;

a trigger lock, wherein the trigger lock unlocks in response to an unlock command, and wherein the trigger lock locks in response to the lock command; and a signal transceiver, wherein the signal transceiver is interconnected to the controller, and wherein the signal transceiver sends the motion detected message to a communication device.

2. The security device of claim 1, wherein the controller is operable to generate and send an unlock command.

3. The security device of claim 2, wherein:

the controller is operable to detect a proximity of a registered communication device to the module and generates and sends the unlock command in response to detecting that the registered communication device is in a vicinity of the module.

4. The security device of claim 2, wherein:

a registered communication device is operable to transmit a lock message and an unlock message to at least one of the transceiver and a system server;

the transceiver is operable to receive the lock message and the unlock message;

the controller generates and sends the lock command in response to the lock message; and the controller generates and sends the unlock command in response to the unlock message.

5. The security device of claim 4, wherein:

the controller generates an unlocked trigger message whenever the trigger lock is unlocked; and the signal transceiver sends the unlocked trigger message to a primary communication device.

6. The security device of claim 1, wherein:

the module is operable to detect when the module is removed from the gun;

the module is operable to generate a module removed signal in response to being removed from the gun;

the controller is operable to generate a module removed message in response to the module removed signal; and the signal transceiver sends the module removed message to at least one of the communication device and a system server.

7. The security device of claim 1, further comprising:

a position module interconnected to the controller, wherein the position module is operable to determine a position of the module, wherein the controller is operable to generate a position message with at least the position of the module, and wherein the signal transceiver is operable to send the position message to at least one of the communication device and a system server.

8. The security device of claim 1, wherein:

a system server is operable to transmit a status update request to the module randomly or on a schedule set by a registered user;

the module is operable to transmit a status update response to the system server; and the system server is operable to transmit a no-response message to the communication device if no status update response is received from the module.

9. The security device of claim 2, wherein:

the controller is operable to generate a status update message randomly or on a schedule set by a registered user;

the signal transceiver is operable to send the status update message to at least one of the communication device and a system server;

the system server and the communication device are operable to transmit an update received message to the controller; and the controller generates a lock command if:

no update received message is received from at least one of the communication device and the system server, or an improper update received message is received from at least one of the communication device and the system server.

10. A method of securing a gun, comprising:

interconnecting a module to the gun, the module covering a trigger guard of the gun, the module including a motion sensor, a controller, a trigger lock, and a transceiver, detecting, by the motion sensor, that the gun has been moved, generating, by the controller, a lock command and an alert message indicating that the gun has been moved, locking, by the trigger lock, in response to receiving the lock command, and outputting, by the transceiver, the alert message.

11. The method of claim 10, further comprising:

interconnecting a position module to the module, wherein the position module is operable to determine a position of the module, and wherein the alert message includes the position of the module.

12. The method of claim 10, further comprising:

detecting a proximity of a registered communication device to the gun; and in response to detecting that the registered communication device is in a vicinity of the gun, generating a signal to unlock the trigger lock.

13. A security system, comprising:

a security module adapted to be attached to a gun and to cover a trigger guard of the gun, including:

a motion sensor, wherein the motion sensor generates a motion signal in response to movement of the motion sensor;

a controller, wherein the controller generates a motion detected message in response to the motion signal generated by the motion sensor, and wherein the controller generates and sends a lock command in response to the motion signal;

a trigger lock, wherein the trigger lock locks in response to the lock command; and a signal transceiver, wherein the signal transceiver is interconnected to the controller, and wherein the signal transceiver sends the motion detected message to at least one of a communication device and a system server.

14. The system of claim 13, further comprising:

a position module interconnected to the controller, wherein the position module is operable to determine a position of the security module, wherein the controller is operable to generate a position message with at least the position of the security module, and wherein the signal transceiver is operable to send the position message to at least one of the communication device and the system server.

15. The system of claim 14, wherein the controller is operable to generate and send an unlock command to the trigger lock, and wherein the trigger lock is operable to unlock in response to the unlock command.

16. The system of claim 15, wherein:

the controller is operable to detect a proximity of a registered communication device to the security module and send the unlock command in response to detecting that the registered communication device is in a vicinity of the security module.

* * * * *